US006354582B1

(12) United States Patent
Hafer et al.

(10) Patent No.: US 6,354,582 B1
(45) Date of Patent: Mar. 12, 2002

(54) BOOKBINDING MACHINE HAVING INTERCHANGEABLE MODULES

(75) Inventors: Siegfried Hafer, Espelkamp; Jurgen Garlichs, Rahden, both of (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 09/415,087

(22) Filed: Oct. 8, 1999

(30) Foreign Application Priority Data

Oct. 9, 1998 (DE) ..... 198 46 525

(51) Int. Cl.[7] ..... B42C 11/02

(52) U.S. Cl. ..... 270/58.07; 412/4; 412/9; 412/18

(58) Field of Search ..... 270/58.01, 58.07, 270/58.08; 412/4, 5, 9, 18; 198/860.2; 156/353, 351, 355, 356, 357, 358

(56) References Cited

U.S. PATENT DOCUMENTS 3,629,043 A * 12/1971 Hoff ..... 156/358
4,881,633 A * 11/1989 Cailey et al. ..... 198/860.2 X
5,125,140 A * 6/1992 Sticht ..... 198/860.2 X
5,904,242 A * 5/1999 Swanson ..... 198/860.2
6,036,003 A * 3/2000 Swanson ..... 198/860.2

FOREIGN PATENT DOCUMENTS

DE 28 10 518 A1 10/1978

* cited by examiner

*Primary Examiner*—Christopher P. Ellis
*Assistant Examiner*—Patrick Mackey
(74) *Attorney, Agent, or Firm*—Alex, Yale & Ristas, LLP

(57) ABSTRACT

A bookbinding machine having an inner-book transporting system, consisting of a conveyer, preferably a roller chain with individual links that engage movably in one another, running around deflecting wheels, and of a multiplicity of clamps, at points of articulation of the conveyer, for clamping-in stacks of leaves, which clamps are disposed at equal mutual distances from one another and so as to be movable, drivewise on the conveyer means, and are guided in tracks on a machine frame, having an entry and an exit and having a number of processing stations along rectilinear conveyer paths, wherein the machine frame (1) has, in the region of the processing stations, a path section (A, B) in a length corresponding to a grid arrangement (R) with a defined basic dimension (x), and processing stations in the form of functional modules (4) in a breadth corresponding to the grid arrangement (R). The processing stations can be inserted at different places in the path section (A, B) in a manner corresponding to the grid arrangement (R) and can be interchanged with one another.

11 Claims, 3 Drawing Sheets

BOOKBINDING MACHINE HAVING INTERCHANGEABLE MODULES

BACKGROUND OF THE INVENTION

The invention relates to a bookbinding machine of the type having an inner-book transporting system, with a conveyer and a multiplicity of clamps, at points of articulation of the conveyer means, for clamping-in stacks of leaves, which clamps are disposed at equal mutual distances from one another and so as to be movable, drivewise, on the conveyer means and are guided in tracks on a machine frame, having an entry and an exit and having a number of processing stations along rectilinear conveyer paths.

A bookbinding machine of this constructional type, a so called adhesive binder, serves to manufacture adhesively bound soft covers or inner books for hard covers, collated leaves or folded sheets being connected to an inner book or inner soft cover by applying an adhesive to the inner-book backs which have previously been processed. During the processing of the backs, the back margin of the folded sheets collated to form an inner book or inner soft cover is completely destroyed. If the functional unit for back processing is not inserted, the subsequent functions can also be used for other binding processes. The binding processes which are possible and the product variants are dependent upon the equipment of the machine. This encompasses the following functional units: inner-book transporting system, back-processing, back-gluing, intermediate drying, page-gluing, back-reinforcement, jacket-applying, pressing-on of jackets and drying.

Some of these functional units may either be absent from the bookbinding machine or else be present several times over. In the case of some functional units, alternative possibilities as regards embodiment exist.

This possibility of combining units results in a considerable diversity of variants and types in various output ranges from 3000 to 18000 cycles or phrases per hour.

From German Patent Specification DE 28 10 518, a bookbinding machine is known which has a machine frame which is formed from the two terminal frame units and various intermediate units which are assembled by means of clamping bars and clamping elements. The number of intermediate units to be connected to the two terminal frame units and also the number of clamps holding the stacks of leaves can be varied in a manner corresponding to the particular format of the stacks of leaves to be bound. The clamps form part of the conveyer means in the form of a continuous chain and the distance of the clamps from one another can be varied by changing the number of chain links between the clamps in a manner corresponding to the format of the leaves. The bookbinding machine permits construction from standardized components and is to be capable of being re-equipped in a relatively rapid and simple manner for the purpose of conveying and processing stacks of leaves having leaf formats of different sizes.

SUMMARY OF THE INVENTION

The primary object of the present invention consists in providing a bookbinding machine of the general type described in the Background, which can be manufactured more economically and thus cost effectively and which permits high functional flexibility and economically optimum adaptation to the various requirements and also diversity of variants.

The object is achieved, according to a first aspect of the invention, through the fact that the machine frame has, in the region of the processing stations, a path section in a length corresponding to a grid arrangement with a defined basic dimension, and processing stations in the form of functional modules are provided in a breadth corresponding to the grid arrangement, which processing stations can be inserted at different places in the path section in a manner corresponding to the grid arrangement and can be interchanged with one another.

Starting out from an inner-book transporting system, consisting of a conveyer means running around deflecting chain wheels and having individual links that engage movably in one another, and of a multiplicity of clamps which are disposed at equal mutual distances from one another and so as to be movable, drive-wise, at the points of articulation of the links of the conveyer means, the bookbinding machine according to a second aspect of the invention is characterized by a conveyer means which is guided in a machine frame of a fixed length, measured between the points of deflection, and which has a defined total number of chain links with a defined chain pitch, and by interchangeable clamps for at least two different maximum format lengths of the stacks of leaves, the product of the number of chain links, in each case, per clamp and phase interval and of the number of clamps being always the same total number of chain links.

Through the invention, the diversity of types of adhesive binders and the associated constant outlay in respect of design and of control technology can be eliminated, while retaining the called-for diversity of variants of equipment. The processing stations, and also alternative embodiments of processing stations, can be interchanged with one another. This independence of the place of installation is provided without any co-ordination of the basic machine and the processing station, design-wise. The use of standardized structural components for recurring functions reduces the diversity of parts and thus leads to a considerable reduction in costs. Customer-specific variants of configuration can be achieved without additional outlay in respect of design and production.

Clamps for various formats of stacks of leaves can be inserted without changing the basic frame or the running tracks for the clamps. As a result of this, the number of clamps can be varied, so that, on the one hand, a higher production capacity is achieved, with the same running-over speed, via processing stations which are independent of format, and on the other hand, the running-over speed is reduced with the same production capacity, something which is useful, for example for achieving a better drying result.

In addition, the number and nature of the processing stations can be further varied, in a manner corresponding to the circumstances of use of the bookbinding machine, by prolonging the basic frame of the machine by inserting intermediate pieces coordinated with the grid arrangement.

BRIEF DESCRIPTION OF THE DRAWINGS

A more detailed description of the preferred embodiment (s) of the invention is set forth below with reference to the accompanying drawings, in which.

DESCRIPTION OF THE PREFERRED EMBODIMENT

Figure 1:
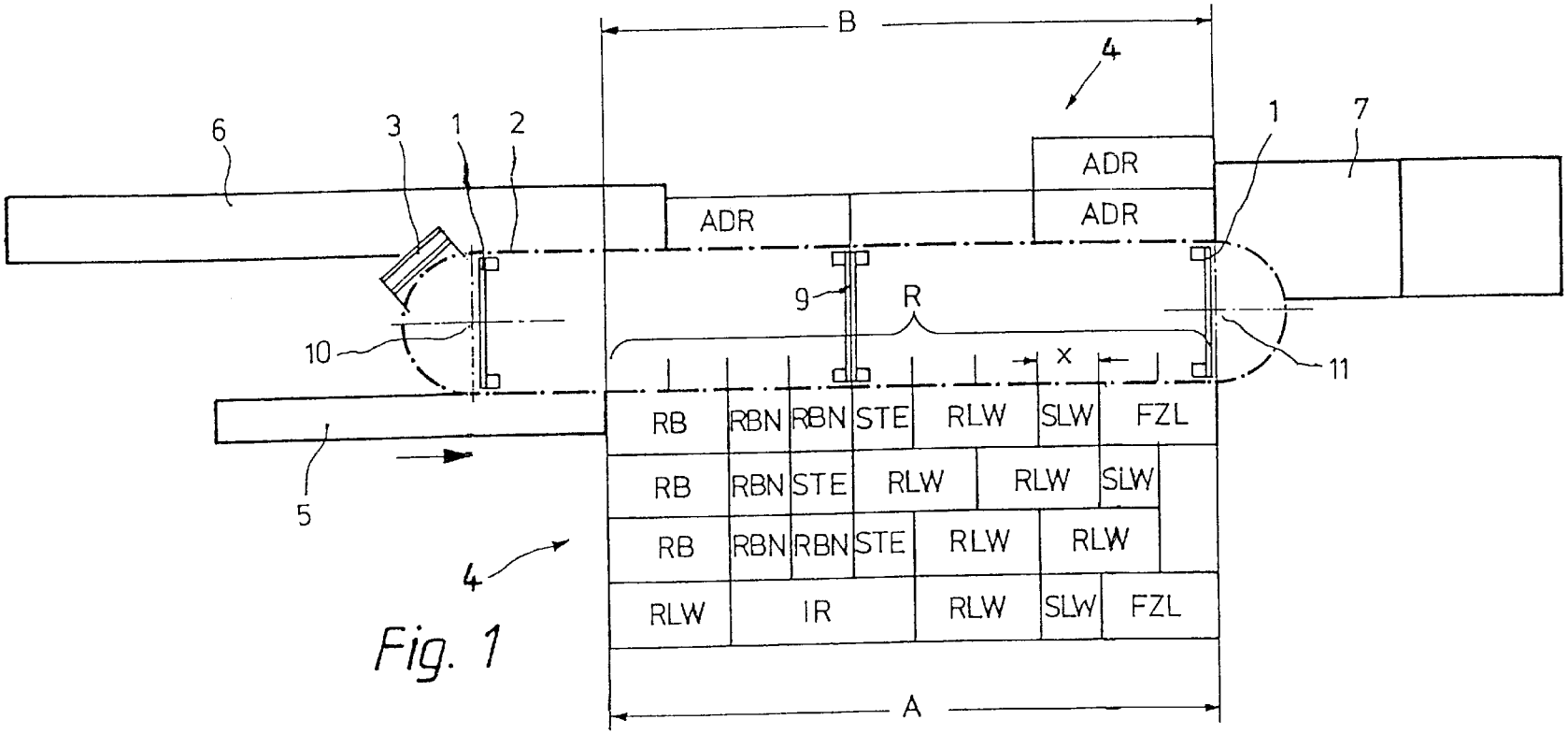
FIG. 1 shows an adhesive binder with possible variants of embodiment.

The adhesive bookbinding machine has a machine frame 1 and an inner-book transporting system having a continuous chain 2 running around deflecting chain wheels and made up of individual links that engage movably in one another and of a multiplicity of clamps 3 which are disposed at equal mutual distances from one another and so as to be movable, drive-wise, at the points of articulation of the chain links and are guided in tracks on the machine frame 1. Processing stations on the straight path sections A and B which are located opposite each other, of an entry 5 and exit 6 in the front part of the machine frame 1, and of a cover-applying arrangement 7 in the rear part of the machine frame 1. The clamps 3, which have an inner clamping jaw 3*a* and an outer clamping jaw 3*b* which can be pivoted via an opener cam and a closing cam, convey the stacks of leaves continuously through the processing stations.

According to the invention, the adhesive binder is designed as a modular system. The machine frame 1 has, in the region of the processing stations, path sections A and B in a length which corresponds to a grid arrangement R with a basic dimension x of 15", and the processing stations are provided, as functional modules 4, with a breadth in the grid arrangement R with a basic dimension x of 15", and can be inserted at different places in the path sections A and B and interchanged with one another. Possible variants of embodiment of the functional modules 4 can be inferred from FIG. 1. Thus, a processing zone comprises a plurality of functional processing modules situated side-by-side along the frame over a rectilinear distance A and/or B which is a multiple of the basic dimension x.

In the adhesive binder, functional modules 4 in a breadth which corresponds to the basic modularity dimension x of 15" are used as follows:

| Functional components | Key | Breadth |
|---|---|---|
| back-processing (milling) | (RB) | 30" |
| back-finishing: | | |
| -levelling (shearing, rubbing) | (RBN) | 15" |
| dust removal | (StE) | 15" |
| back-gluing mechanism | (RLW) | 30" |
| IR drying | (JR) | 45"/75" |
| page-gluing mechanism | (SLW) | 15" |
| slip-folding station | (FZL) | 45" |
| pressing-on station | (ADR) | 45" |
| HF drying | (HF) | 60"/120" |

Figure 2:
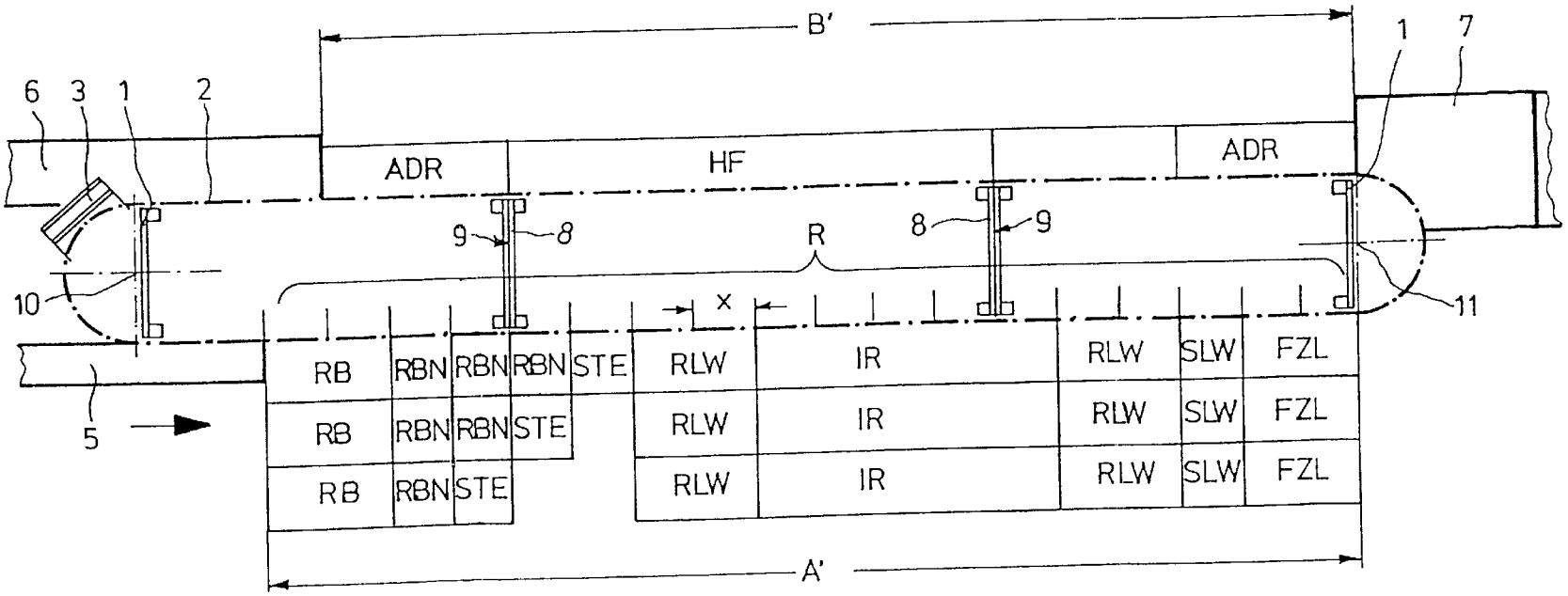
FIG. 2 shows the adhesive binder with a prolonged machine frame and with possible variants of embodiment added.

As can be seen from FIG. 2, the machine frame 1 is constructed so as to be capable of being divided at the point of intersection designated by the position numeral 9, and is supplemented, by the insertion of an intermediate piece 8 in a length corresponding to the grid arrangement R with a basic dimension x of 15" for supplementing functional modules 4 for the particular purpose for which the adhesive binder is being used. The insertion of intermediate pieces of different lengths in the length corresponding to the grid arrangement R with a basic dimension x of 15" offers further possibilities for varying the adhesive binder.

Starting from a predetermined length of the machine frame 1 between the points of deflection 10 and 11, the chain 2 has, according to the invention, a number of, for example, 240 chain links with a chain pitch of 2", to which it is possible to interchangeably fasten a certain number of clamps 3 with a certain number of chain links at phase intervals of 610, 508 and 406 mm, in each case, for stacks of leaves with maximum format lengths of 515, 415 and 315 mm. The product of the number of chain links per phase interval and of the number of clamps, is always the same number of chain links. As can be seen from the accompanying Table, clamps 3 numbering 20, 24 and 30 for the three different stacks of leaves can thus be interchanged without changing the machine frame 1 or the running tracks for the clamps on the chain 2 with 240 chain links, a fact which permits, on the one hand, an increase in production capacity while maintaining the running-over speed, and on the other hand, a reduction in the running over speed while maintaining production capacity.

For the purpose of extending the adhesive binder by increasing the number of clamps 3, links in the chain 2 and functional modules 4, the machine frame 1 can be divided between the points of deflection 10 and 11 of the conveyer means 2 and is supplemented by at least one intermediate piece 8 in a length which corresponds to a multiple of the chain pitch, consistent with basic dimension x. The conveying chain driven on the track, has a rectilinear path of distance B through the processing zone, wherein each of the functional modules has a breadth dimension along the rectilinear path which is a multiple of the basic dimension x, and is interchangeable in the processing zone with other of the functional modules.

Figure 3A:
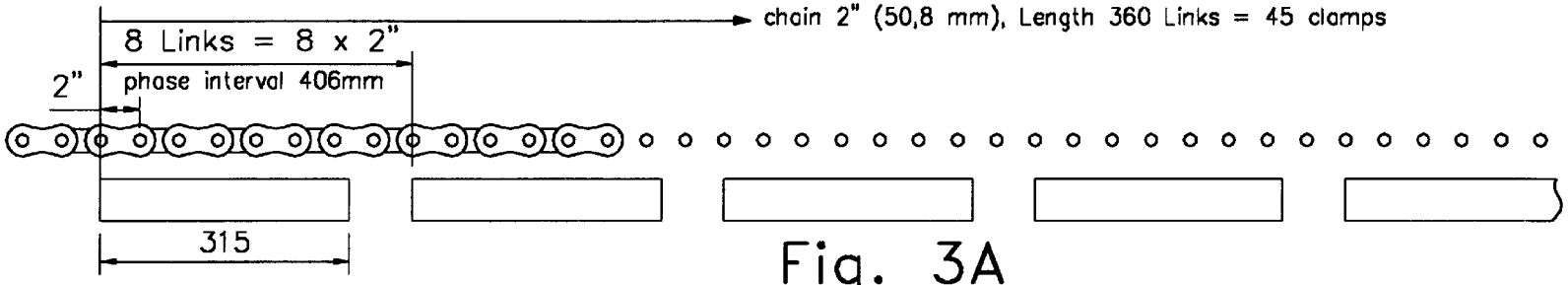
FIG. 3 shows how interchangeable clamps having three different maximum format lengths can be used on a chain having the same number of links.
Figure 3B:
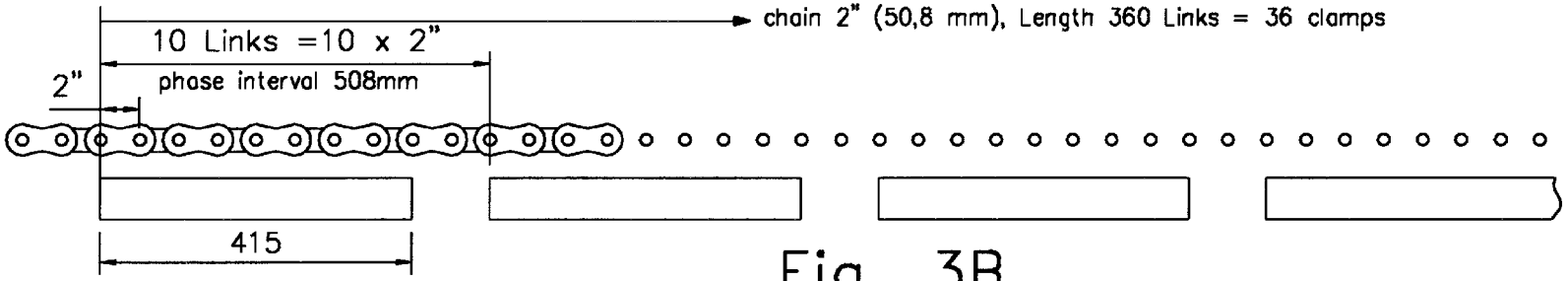
Figure 3C:
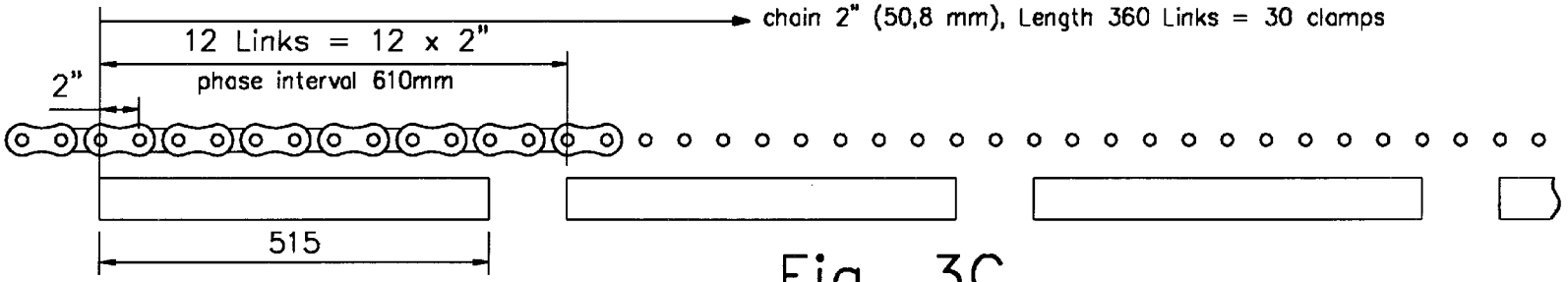

In order to be able to interchange the clamps 3 for the various maximum format lengths of the stacks of leaves, the product of the phase interval and of the number of clamps must, once again, always be the same total number of chain links. As used herein, "phase interval" means the distance in mm along the chain between the leading edge of one clamp and the leading edge of the next clamp, regardless of the actual physical dimension of the clamp. For example, in a set of clamps wherein a clamp and trailing space between the next clamp together span 12 links (at 50.8 mm each) the phase interval is 610 mm. The Table and FIG. 3 show that a line which has 30 such clamps, requires a total of 360 links. In the case of the three different maximum format lengths 515, 415 and 315, a number of 360 chain links, for example, emerges from the Table for numbers of 30, 36 and 45 clamps.

Thus, it can be seen that the conveyor means is a continuous link chain having opposed rectilinear portions which transition at deflection points into opposed curved portions. The processing zone is situated over the rectilinear distance B, along each of the opposed rectilinear portions of the chain, whereby the rectilinear distance B is spanned by a defined total number of links each having a pitch. A first set of interchangeable clamps for clamping in stacks of leaves corresponding to a first maximum format length, are disposed at first equal phase intervals along the full length of the chain. If a format change is desired, a second set of interchangeable clamps corresponding to the new maximum format length, are interchanged with the first set of clamps at corresponding second phase intervals along the full length of the chain. In both instances, the product of the number of first clamps and first phase interval is equal to the product of the number of second clamps and the second phase interval.

Thus, it may be appreciated from the foregoing description, that the number of clamps can be varied so that a higher production capacity is achieved, with the same running speed, via processing stations which are independent of the format. Furthermore, the running speed can be reduced with the same production capacity, for example to achieve a better drying result.

Transporting Clamps Table

| number of clamps | number of links per clamp 8 | 9 | 10 | 11 | 12 |
|---|---|---|---|---|---|
| 14 | | | | | 168 |
| 15 | | | | 165 | 180 |
| 16 | | | 160 | 176 | 192 |
| 17 | | 153 | 170 | 187 | 204 |
| 18 | | 162 | 180 | 198 | 216 |
| 19 | 152 | 171 | 190 | 209 | 228 |
| 20 | 160 | 180 | 200 | 220 | 240 |
| 21 | 168 | 189 | 210 | 231 | 252 |
| 22 | 176 | 198 | 220 | 242 | 264 |
| 23 | 184 | 207 | 230 | 253 | 276 |
| 24 | 192 | 216 | 240 | 264 | 288 |
| 25 | 200 | 225 | 250 | 275 | 300 |
| 26 | 208 | 234 | 260 | 286 | 312 |
| 27 | 216 | 243 | 270 | 297 | 324 |
| 28 | 224 | 252 | 280 | 308 | 336 |
| 29 | 232 | 261 | 290 | 319 | 348 |
| 30 | 240 | 270 | 300 | 330 | 360 |
| 31 | 248 | 279 | 310 | 341 | 372 |
| 32 | 256 | 288 | 320 | 352 | 384 |
| 33 | 264 | 297 | 330 | 363 | 396 |
| 34 | 272 | 306 | 340 | 374 | 408 |
| 35 | 280 | 315 | 350 | 385 | 420 |
| 36 | 288 | 324 | 360 | 396 | 432 |
| 37 | 296 | 333 | 370 | 407 | 444 |
| 38 | 304 | 342 | 380 | 418 | 456 |
| 39 | 312 | 351 | 390 | 429 | 468 |
| 40 | 320 | 360 | 400 | 440 | 480 |
| 41 | 328 | 369 | 410 | 451 | 492 |
| 42 | 336 | 378 | 420 | 462 | 504 |
| 43 | 344 | 387 | 430 | 473 | 516 |
| 44 | 352 | 396 | 440 | 484 | 528 |
| 45 | 360 | 405 | 450 | 495 | 540 |
| 46 | 368 | 414 | 460 | 506 | |
| 47 | 376 | 423 | 470 | 517 | |
| 48 | 384 | 432 | 480 | 528 | |
| 49 | 392 | 441 | 490 | | |
| 50 | 400 | 450 | 500 | | |
| chain link 2' = 50.8 mm | | | | | |
| phase interval | 406 | 457 | 508 | 559 | 610 |
| max. format | 315 | 360 | 415 | 460 | 515 |

What is claimed is:

1. A bookbinding machine having an inner-book transporting system, comprising a conveyer having a roller-chain with individual links that engage movably in one another, continuously running around deflecting wheels, and a multiplicity of clamps for clamping-in stacks of leaves, which clamps are disposed at equal mutual distances from one another so as to be movable, drive-wise, at points of articulation of the conveyer and are guided in tracks on a machine frame that has an entry, an exit, and a multiplicity of processing stations along a linear conveyer path in a processing region of the machine frame, wherein the improvement comprises that the machine frame has a conveyer path section (A) of a length corresponding to a grid arrangement (R) of processing stations with a defined basic dimension (X), and said multiplicity of processing stations are in the form of discreet functional modules each having a breadth along the path that is a multiple of dimension (X), which processing stations are insertable at different places in the path section (A) in the grid arrangement (R) and can be interchanged with one another.

2. The bookbinding machine according to claim 1, wherein the processing region includes parallel conveyer path sections (A, B) and each section has a length corresponding to a grid arrangement (R) of processing stations with a defined basic dimension (X), and said multiplicity of processing stations are in the form discreet functional modules each have a breadth along the respective path that is a multiple of dimension (X), which processing stations are insertable at different places in the path sections (A, B) in the respective grid arrangement (R) and can be interchanged with one another.

3. Bookbinding machine according to claim 2, wherein said machine is extendable with an increased number of clamps, links in the conveyer, and functional modules, by dividing the machine and elongating the path sections (A, B) by inserting at least one intermediate frame piece in a length corresponding to the grid arrangement (R) with the defined basic dimensional (X).

4. Bookbinding machine according to claim 1 wherein the length of the path sections and the breadth of the functional modules correspond to a grid arrangement (R) with a basic dimension (X) of 15 inches.

5. Bookbinding machine according to claim 3, wherein the length of the path sections and the breadth of the functional modules correspond to a grid arrangement (R) with a basic dimension (X) of 15 inches.

6. Bookbinding machine having an inner-book transporting system comprising a conveyer continuously running around deflecting chain wheels and having individual links that engage movably in one another, and a multiplicity of clamps for clamping-in stacks of leaves, which clamps are disposed at equal mutual distances from one another so as to be movable, drive-wise, as points of articulation of the links of the conveyer and are guided in tracks on a machine frame that has an entry, an exit, and a multiplicity of processing stations along rectilinear conveyer paths in a processing region, wherein the improvement comprises that the machine frame has a fixed length, as measured between the points of deflection (10, 11) of the conveyer (2), by a defined total number of chain links with a chain pitch; interchangeable clamps (3) are provided for at least two different maximum format length of the stacks of leaves; and the product of the number of chain links per clamp phase interval and the number of clamps, is always the same total number chain links; wherein said machine is extendable with an increased number of clamps (3), links in the conveyer (2), and functional modules (4), by dividing the machine frame (1) between the points of deflection (10, 11) and elongating the conveyer by at least one intermediate piece (8) in a length corresponding to a multiple of the chain pitch, and interchangeable clamps (3) for at least two maximum format length of the stacks are provided, the product of the number of chain links per clamp phase interval and of the number of clamps remaining equal to the same total number of chain links.

7. Bookbinding machine according to claim 6 wherein the conveyer is a toothed belt.

8. Bookbinding machine according to claim 6, wherein the conveyer includes a roller chain (2) with a chain pitch of 2 inches.

9. Bookbinding machine comprising:

a frame which supports a conveying track;

a processing zone comprising a plurality of functional processing modules situated side by side along the frame over a rectilinear distance B which is a multiple of a basic dimension X;

conveying means continuously driven on said track, having a rectilinear path of distance B through the processing zone;

wherein each of said functional modules, has a breadth dimension along said rectilinear path, which is a multiple of said basic dimension X and is interchangeable in the processing zone with other of said functional modules.

10. The booking machine of claim 9, wherein the conveyor means is a continuous link chain having opposed rectilinear portions which transition at deflection points into opposed curved portions;

a processing zone is situated over rectilinear distances A, B respectively along each of the opposed rectilinear portions of the chain, whereby the rectilinear distances A, B are spanned by a defined total number of links each having a pitch;

a first set of interchangeable clamps for clamping-in stacks of leaves corresponding to a first maximum format length, are disposed at first equal phase intervals along said total number of links;

a second set of interchangeable clamps for clamping-in stacks of leaves corresponding to a second maximum format length, are associated with the machine for interchanging with the first set of clamps at corresponding second equal phase intervals along said total number of links;

wherein the product of the number of first clamps and first phase intervals is equal to the product of the number of second clamps and second phase intervals.

11. The bookbinding machine of claim 10, wherein the machine can be extended by increasing the number of clamps, links in the conveyor means, and functional modules, by dividing the machine frame and elongating the processing zones by the insertion of an intermediate piece having a length which is a multiple of the basic dimension X.

* * * * *